US010820625B2

(12) United States Patent
Lindholm Delaloye et al.

(10) Patent No.: US 10,820,625 B2
(45) Date of Patent: Nov. 3, 2020

(54) SMOKING ARTICLE WITH VENTILATED MOUTH END CAVITY

(71) Applicant: PHILIP MORRIS PRODUCTS S.A., Neuchatel (CH)

(72) Inventors: Cecilia Lindholm Delaloye, Preverenges (CH); Alen Kadiric, Orpund (CH)

(73) Assignee: Philip Morris Products S.A., Neuchatel (CH)

( * ) Notice: Subject to any disclaimer, the term of this patent is extended or adjusted under 35 U.S.C. 154(b) by 16 days.

(21) Appl. No.: 15/306,168

(22) PCT Filed: May 29, 2015

(86) PCT No.: PCT/EP2015/061951
§ 371 (c)(1),
(2) Date: Oct. 24, 2016

(87) PCT Pub. No.: WO2015/181354
PCT Pub. Date: Dec. 3, 2015

(65) Prior Publication Data

US 2017/0042219 A1 Feb. 16, 2017

(30) Foreign Application Priority Data

May 30, 2014 (EP) ..... 14170594

(51) Int. Cl.
*A24D 3/04* (2006.01)
*A24D 3/02* (2006.01)

(52) U.S. Cl.
CPC ..... *A24D 3/043* (2013.01); *A24D 3/0291* (2013.01)

(58) Field of Classification Search
None
See application file for complete search history.

(56) References Cited

U.S. PATENT DOCUMENTS 4,380,241 A 4/1983 Horsewell
4,564,030 A * 1/1986 Jessup ..... A24D 3/043 131/336

(Continued)

FOREIGN PATENT DOCUMENTS

CN 101128130 2/2008
CN 101442917 5/2009

(Continued)

OTHER PUBLICATIONS

European Search Report for Application No. 14170594 dated Nov. 4, 2014 (2 pages).

(Continued)

*Primary Examiner* — Phu H Nguyen
(74) *Attorney, Agent, or Firm* — Mueting Raasch Group

(57) ABSTRACT

A smoking article comprises a tobacco rod and a filter connected to the tobacco rod. The filter comprises a first filter segment and a hollow tube segment downstream of the first filter segment. The hollow tube segment defines a cavity at the mouth end of the filter providing an unrestricted flow channel that extends from the downstream end of the first filter segment to the mouth end of the filter. The length of the hollow tube segment is at least about (25) percent and less than about (50) percent of the overall filter length. Further, the smoking article comprises a ventilation zone in communication with the cavity at a location along the hollow tube segment.

11 Claims, 2 Drawing Sheets

(56) References Cited

U.S. PATENT DOCUMENTS

| | | | | |
|---|---|---|---|---|
| 5,435,326 | A * | 7/1995 | Gentry | A24D 3/043 131/338 |
| 6,502,582 | B1 | 1/2003 | Peters | |
| 7,669,604 | B2 * | 3/2010 | Crooks | A24D 3/043 131/341 |
| 7,878,963 | B2 | 2/2011 | Li | |
| 8,960,199 | B2 | 2/2015 | Zhuang | |
| 2005/0066980 | A1 | 3/2005 | Crooks | |
| 2009/0293894 | A1 | 12/2009 | Cecchetto | |
| 2015/0027476 | A1 | 1/2015 | Gambs | |

FOREIGN PATENT DOCUMENTS

| | | |
|---|---|---|
| CN | 103476279 | 12/2013 |
| EA | 001553 | 4/2001 |
| EA | 002654 | 8/2002 |
| WO | WO 2007/110650 | 10/2007 |
| WO | WO 2008/059377 | 5/2008 |
| WO | WO 2014/023555 | 2/2014 |
| WO | WO 2014/023557 | 2/2014 |

OTHER PUBLICATIONS

Office Action issued in Kazakhstan for Application No. 2016/1161.1 dated Apr. 6, 2018 (7 pages). English translation included.
Office Action issued in Russia for Application No. 2016151695 dated Aug. 29, 2018 (11 pages). English translation included.
Office Action issued in China for Application No. 201580025918.4 dated Jan. 30, 2019 (English translation included).
PCT Search Report and Written Opinion for PCT/EP2015/061951 dated Aug. 13, 2015 (9 pages).

* cited by examiner

SMOKING ARTICLE WITH VENTILATED MOUTH END CAVITY

This application is a U.S. National Stage Application of International Application No. PCT/EP2015/061951, filed May 29, 2015, which was published in English on Dec. 3, 2015, as International Publication No. WO 2015/181354 A1. International Application No. PCT/EP2015/061951 claims priority to European Application No. 14170594.7 filed May 30, 2014.

The present invention relates to a smoking article having a mouth end cavity defined by a hollow tube segment.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod. Smoking articles having a cavity at the mouth end of their filter section have also been proposed.

A number of smoking articles in which tobacco is heated rather than combusted have also been proposed in the art. In heated smoking articles, an aerosol is generated by heating an aerosol generating substrate, such as tobacco. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract or other nicotine source, without combustion and in some cases without heating, for example through a chemical reaction.

It would be desirable to provide a filtered smoking article having a mouth end cavity which is adapted to promote homogenization of the mainstream smoke prior to it reaching the mouth of the consumer.

Accordingly, the present invention provides a smoking article comprising a tobacco rod and a filter connected to the tobacco rod. The filter comprises at least a first filter segment and a hollow tube segment downstream of the first filter segment. The hollow tube segment defines a cavity at the mouth end of the filter providing an unrestricted flow channel that extends from the downstream end of the first filter segment to the mouth end of the filter. The length of the hollow tube segment is at least about 25 percent and less than about 50 percent of the overall filter length. Further, the smoking article comprises a ventilation zone in communication with the cavity at a location along the hollow tube segment.

As used herein, the terms "upstream" and "downstream" are used to describe the relative positions of elements, or portions of elements, of the smoking article in relation to the direction in which a consumer draws on the smoking article during use thereof. Smoking articles as described herein comprise a downstream end and an opposed upstream end. In use, a consumer draws on the downstream end of the smoking article. The downstream end, which is also described as the mouth end, is downstream of the upstream end, which may also be described as the distal end.

The expression "unrestricted flow" is used throughout this specification to indicate that the hollow tube segment internally defines a channel having a substantially constant cross-sectional area for the smoke and air to flow through. Further, the expression "unrestricted flow channel" is used throughout this specification to indicate that the hollow tube segment does not contain any object which may cause a local restriction of the flow of the smoke and air. In other words, the hollow tube segment is empty. Thus, the cross-sectional area available for the smoke and air to flow through is substantially constant along the whole length of the hollow tube segment and flow of smoke and air through the hollow tube segment is substantially unobstructed.

The expression "overall filter length" is used throughout this specification to refer to the sum of the length of the various components forming the filter. Thus, the expression "overall filter length" should be construed as referring at least to the sum of the length of the hollow tube segment and the length of the first filter segment. Similarly, if the smoking article comprises more than one filter segments upstream of the hollow tube segment, the expression "overall filter length" should be construed as referring to the sum of the length of the hollow tube segment and the length of each of the other filter segments in the smoking article.

According to the present invention, the inclusion of a filter comprising an unrestricted hollow tube segment and a ventilation zone having the features specified above advantageously enables the production of smoking articles in which an improved dispersion of air and mainstream smoke at the mouth end is achieved. Without wishing to be bound to theory, the provision of a ventilation zone in communication with the unrestricted channel internally defined by the hollow tube is understood to promote turbulent flow of air and mainstream smoke through the filter of the smoking article and, in particular, at the downstream end of the filter. As is known, turbulent flows favour the homogenization of fluid mixtures by enhancing the rates of mass, momentum and energy transports in a flow. Because the hollow segment represents at least 25 percent, and less than about 50 percent, of the overall length of the filter, the air drawn into the filter via the ventilation zone and the mainstream smoke are provided room for intimately mixing under turbulent flow conditions prior to leaving the filter. Thus, in smoking articles in accordance with the present invention, a better dispersed flow of air and mainstream smoke advantageously reaches the mouth of the consumer.

Further, the length of the filter segment or segments upstream of the hollow tube segment thus accounts for at least about 50 percent of the overall filter length. The unrestricted, hollow tube segment does not substantially contribute to increasing the resistance to draw (RTD) of the smoking article. At most, the unrestricted, hollow tube segment contributes only marginally to increasing the RTD of the smoking article. In practice, the unrestricted, hollow tube segment may be adapted to generate a RTD in the range of approximately 1 mm $H_2O$ (about 10 Pa) and approximately 20 mm $H_2O$ (about 200 Pa). Preferably, the unrestricted, hollow tube segment is adapted to generate a RTD between approximately 2 mm $H_2O$ (about 20 Pa) and approximately 10 mm $H_2O$ (about 100 Pa). Because the filter segment or segments upstream of the unrestricted, hollow tube segment account for at least about 50 percent of the overall filter length, it is advantageously possible, by selecting filtration material or materials of appropriate density and characteristics, to adjust the overall RTD of the smoking article to satisfactory levels. In some preferred embodiments, the filter segment or segments upstream of the unrestricted, hollow tube segment account for at least about 60 percent of the overall filter length.

Preferably, the length of the hollow tube segment is less than about 25 mm. Preferably, the length of the hollow tube segment is less than about 15 mm. In addition, or as an alternative, the length of the hollow tube segment is at least about 10 mm. In some preferred embodiments, the length of the hollow tube segment is from about 10 mm to about 15 mm. This not only provides a mouth end cavity and an unrestricted flow channel of an appropriate size, but also ensures sufficient overlap between the hollow tube segment and any wrapper which may circumscribe the hollow tube segment to maintain it in axial alignment with the filter segment or with the tobacco rod or with both. Such wrappers include plug wraps and tipping paper bands.

Preferably, the ventilation zone is located at least about 2 mm upstream from the mouth end of the filter. More preferably, the ventilation zone is located at least about 2 mm upstream from the mouth end of the filter. This advantageously makes it less likely for the consumer to obstruct the ventilation zone when holding the smoking article with his or her lips. Preferably, the ventilation zone is located at least about 10 mm upstream from the mouth end of the filter.

In addition, or as an alternative, the ventilation zone is preferably located less than about 20 mm upstream from the mouth end of the filter. More preferably, the ventilation zone is preferably located less than about 15 mm upstream from the mouth end of the filter. In some preferred embodiments, the ventilation zone is preferably located from about 2 mm to about 20 mm upstream from the mouth end of the filter. In some more preferred embodiments, the ventilation zone is preferably located from about 10 mm to about 15 mm upstream from the mouth end of the filter. This provides a highly appropriate length of unrestricted flow channel for the air and smoke to flow through under turbulent conditions and, therefore, to thoroughly mix before they reach the mouth end of the smoking article.

In addition, or as an alternative, the ventilation zone is located at least about 1 mm downstream from the downstream end of the first filter segment, preferably at least about 2 mm downstream from the downstream end of the first filter segment. More preferably, the ventilation zone is located at least about 5 mm downstream from the downstream end of the first filter segment. Even more preferably, the ventilation zone is located at least about 10 mm downstream from the downstream end of the first filter segment. Thus, the air being drawn into the cavity defined by the hollow tube segment in a substantially radial direction encounters the mainstream smoke flowing into the cavity from the first filter segment substantially along an axial direction. Without wishing to be bound to theory, this is understood to favour dragging of the air drawn into the cavity on the part of the mainstream smoke flowing in the axial direction, thus further promoting thorough mixing and homogenization of air and mainstream smoke within the cavity.

Preferably, the ventilation zone comprises at least one circumferential row of perforations provided through the hollow tube segment. In some preferred embodiments, the ventilation zone comprises two circumferential rows of perforations provided through the hollow tube segment. For example, the perforations may be formed online during manufacture of the smoking article. Preferably, each circumferential row of perforations comprises from 8 to 30 perforations.

The tobacco rod typically comprises a charge of tobacco cut filler circumscribed by a paper wrapper.

The hollow tube segment and the filter segment or segments are circumscribed by a band of plug wrap. Preferably, the hollow tube segment and the filter segment or segments are circumscribed by a band of impermeable plug wrap. In an alternative embodiment, the hollow tube segment and filter segment or segments are circumscribed by a band of substantially air permeable plug wrap, more preferably a band of plug wrap having a permeability of between about 7,000 Coresta units and about 20,000 Coresta units.

The plug wrap may have a basis weight of less than about 120 gsm, preferably less than about 100 gsm, more preferably less than about 80 gsm. In addition, or as an alternative, the plug wrap may have a basis weight of at least about 20 gsm, preferably at least about 25 gsm. The combining plug wrap preferably has a basis weight of more than about 20 gsm.

The band of plug wrap may be affixed to the hollow tube segment and the filter segment or segments using, for example, an adhesive. Where the filter comprises a band of substantially air impermeable plug wrap, the ventilation zone preferably comprises at least one circumferential row of perforations provided through a portion of the plug wrap. By way of example, the perforations through the plug wrap may be formed online during manufacture of the smoking article. Preferably, the circumferential row or rows of perforations provided through a portion of the plug wrap are in substantial alignment with the corresponding row or rows of perforations provided through the hollow tube segment.

The filter comprising the band of plug wrap is preferably attached to the tobacco rod by a band of substantially impermeable tipping paper. The tipping wrapper may comprise paper having a basis weight of less than about 70 gsm, preferably less than about 50 gsm. The tipping wrapper preferably has a basis weight of more than about 20 gsm.

The band of tipping paper may extend over the whole length of the filter and over a portion of the tobacco rod. Thus, the band of tipping paper may overlap ventilation perforations provided through the hollow tube segment. As an alternative, the band of tipping paper may extend over only a portion of the filter and over a portion of the tobacco rod, that is substantially at the junction of filter and tobacco rod. Thus, at least in some embodiments, the band of tipping paper may not overlap ventilation perforations provided through the hollow tube segment.

Where the smoking article comprises a band of tipping paper that extends over ventilation perforations provided through the hollow tube segment and/or the filter plug wrap, the band of tipping paper also comprises one or more rows of ventilation perforations. Preferably, the circumferential row or rows of perforations provided through the tipping paper are in substantial alignment with the corresponding row or rows of perforations provided through the hollow tube segment and/or the filter plug wrap.

As mentioned above, smoking articles according to the present invention may comprise additional filter segments in combination with the first filter segment. For example, in one embodiment, the smoking article further comprises a rod end segment of filtration material between the first filter segment and the tobacco rod.

The filtration material within each filter segment of the smoking article is preferably a plug of fibrous filtration material, such as cellulose acetate tow or paper. A filter plasticiser may be applied to the fibrous filtration material in a conventional manner, by spraying it onto the separated fibres, preferably before applying any additional material to the filtration material. Alternatively, or in addition, smoking articles in accordance with the present invention may include one or more segments containing carbon, preferably a rod end segment containing carbon.

The hollow tube segment is preferably formed from a paper material. More preferably, the hollow tube segment is formed from a plurality of overlapping paper layers, such as a plurality of parallel wound paper layers or a plurality of spirally wound paper layers. Forming the hollow tube segment from a plurality of overlapping paper layers can help to improve resistance to collapse or deformation.

Preferably each hollow tube segment comprises at least two paper layers. Alternatively, or additionally, each hollow tube segment preferably comprises fewer than eleven paper layers.

Preferably, the wall thickness of the hollow tube segment is at least about 90 micrometres. More preferably, the wall thickness of the hollow tube segment is at least about 100 micrometres. Alternatively, or in addition, the wall thickness of the hollow tube segment is less than about 140 micrometres. Preferably, the wall thickness of the hollow tube segment is less than about 130 micrometres. In some preferred embodiments, the wall thickness of the hollow tube segment is from about 90 micrometres to about 140 micrometres, preferably from 100 micrometres to 130 micrometres.

An exemplary method for forming a tube segment from a plurality of wound paper layers comprises wrapping a plurality of substantially continuous paper strips in an overlapping manner about a cylindrical mandrel. The strips are wrapped in a parallel manner or a spiral manner so as to form a substantially continuous tube on the mandrel. The formed tube may be turned about the mandrel, for example using a rubber belt, so that the paper layers are continually drawn and wrapped around the mandrel. The formed tube can then be cut into the required lengths downstream of the mandrel.

One factor that may restrict the ability of the hollow tube segment to retain its ovality during smoking of the smoking article is absorption of moisture into the tube segment during smoking. Therefore, to inhibit the transfer of moisture from one paper layer to the next during smoking of the smoking article, adjacent paper layers of each tubular member are preferably adhered together by an intermediate layer of adhesive, which provides a barrier to the transfer of moisture between layers.

In any of the embodiments described above, the resistance of the hollow tube segment to collapse or deformation may be such that the difference between the ovality of the tube segment after 50 percent deformation of the filter and the ovality of the tube segment prior to deformation is less than about 25 percent, preferably less than about 20 percent. For example, where the ovality of the tube segment prior to deformation is 5 percent, the ovality of the tube segment after a 50 percent deformation of the filter is preferably less than 30 percent, more preferably less than 25 percent. The particular test procedure for conducting deformations of the filter in accordance with present invention is described in detail below.

The term "ovality" as used herein means the degree of deviation from a perfect circle. Ovality is expressed as a percentage and the mathematical definition is given below.

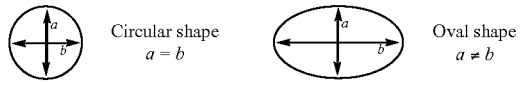

$$ovality\ (percent) = \frac{2\,(a - b)}{a + b} \times 100\ percent$$

To determine the ovality of a segment of a smoking article (such as a hollow tube segment) in accordance with the present invention, the mouth end is viewed along the longitudinal direction of the smoking article. For example, the smoking article can be positioned on its mouth end on a transparent stage so that an image of the mouth end of the article is recorded by a suitable imaging device located below the stage. Dimension "a" is taken to be the smallest external diameter of the segment at its downstream end and dimension "b" is taken to be the largest external diameter of the segment at its downstream end. The process is repeated for a total of ten smoking articles having the same design and the number average of the ten ovality measurements is recorded as the ovality for that design of smoking article.

Since smoking article filters are generally circular in cross section, the ovality of the hollow tube segment after a 50 percent deformation is preferably less than about 25 percent, more preferably less than about 20 percent. In this case, the mouth end cavity of smoking articles in accordance with the present invention will retain or resume a generally circular cross section, even after a 50 percent deformation of the filter. Alternatively, or in addition, the ovality of the tube segment after a 67 percent deformation of the filter is preferably less than about 35 percent, more preferably less than about 30 percent.

In some embodiments, the ovality of the hollow tube segment after a 50 percent deformation of the filter performed after the smoking article has been subjected to a smoking test is preferably less than about 35 percent, more preferably less than about 30 percent. Alternatively, or in addition, the ovality of the tube segment after a 67 percent deformation of the filter performed after the smoking article has been subjected to a smoking test is preferably less than about 45 percent, more preferably less than about 40 percent. This advantageously provides consistency in the ovality of the mouth end cavity during smoking of the smoking article.

The smoking test used for testing smoking articles in accordance with the present invention is described in detail below. Where it is necessary to measure the ovality after deformation tests performed both before and after smoking, two samples of smoking articles having the same design should be used. That is, a non-deformed un-smoked smoking article should be used for the pre-smoking deformation test, and non-deformed articles having the same design are subjected to the smoking test and used for the post-smoking deformation test.

As discussed above, one factor that may restrict the ability of the hollow tube segment to retain its ovality during smoking of the smoking article is absorption of moisture into the tube segment. Therefore, the hollow tube segment may comprise a coating layer on an inner surface thereof, which can inhibit absorption of moisture into the hollow tube segment. In those embodiments in which the hollow tube segment is formed from a plurality of paper layers, a coating layer may additionally or alternatively be provided between some or all of the adjacent paper layers. Suitable coating materials include, but are not limited to, waxes, polymeric materials and combinations thereof. Particularly suitable waxes include vegetable waxes, and other particularly suitable materials are ethyl-cellulose and nitrocellulose.

To increase the resistance of the hollow tube segment to crushing, the filter preferably has an un-smoked compressive strength of at least about 20 Newtons at 50 percent compression. Alternatively, or in addition, the un-smoked compressive strength of the filter at 50 percent compression is preferably less than about 50 Newtons. The term "compressive strength" is a measure of the force required to provide a particular compression of the filter section of the smoking article. Compressive strength is measured using the compressive strength test described in detail below, where the compressive strength of a given smoking article design is the number average of the compressive strength measurements for a sample of ten smoking articles having the same design.

In some embodiments, it may be desirable to provide the filter with means for releasing a flavourant or other additive on demand, usually via manual release by the consumer immediately prior to smoking the article. Therefore, the filter may comprise at least one filter segment including a flavourant containing material, such as, for example, one or more breakable capsules comprising an outer shell and an inner core containing an additive. Preferably the at least one filter segment comprises one or more breakable capsules dispersed within a fibrous filtration material. The at least one filter segment may be the first filter segment, or an additional filter segment which may be incorporated into the filter, or a combination thereof.

In embodiments comprising a flavourant containing material, the at least one flavour containing filter segment is preferably circumscribed by a plug wrap that is substantially impermeable to the flavourant additive. This advantageously inhibits transfer of the additive through the plug wrap to the outside of the smoking article, where it may undesirably come into contact with the consumer's fingers and may tarnish the appearance of the smoking article.

Test Procedures

Deformation and Compressive Strength Test

The smoking article to be tested is positioned between a flat surface and a circular plate opposed to the flat surface, the circular plate having a diameter of 10 mm. The of the circular plate closest to the mouth end of the smoking article is positioned 8 mm from the mouth end. The filter is then compressed by moving the circular plate towards the flat surface at a constant speed of 100 mm per second. The force applied by the circular plate is increased until the desired deformation of the portion of the smoking article between the circular plate and the flat surface is achieved. For example, to achieve a 50 percent deformation, the compressed portion of the smoking article is compressed to a diameter of 50 percent of the diameter of that portion prior to compression. Similarly, to achieve a 67 percent deformation, the smoking article is compressed until the compressed portion is reduced to a diameter of 33 percent of the diameter of that portion prior to compression. The diameter is measured in the direction of compression, which is the direction extending between the flat surface and the circular plate. Once the desired compression has been achieved, the force required to provide that compression is noted as the compressive strength of the filter. The circular plate is then retracted so that the compressive force is removed. The smoking article is left for 30 seconds to expand before any further tests or measurements are performed.

Smoking Test

To simulate the smoking of a smoking article, the smoking article is subjected to a standard smoking test under ISO conditions (35 ml puffs lasting 2 seconds each, every 60 seconds). In the ISO test method, the smoking article is smoked with the ventilation zone fully uncovered.

The invention will now be further described, by way of example only, with reference to the accompanying drawings in which.

Figure 1:
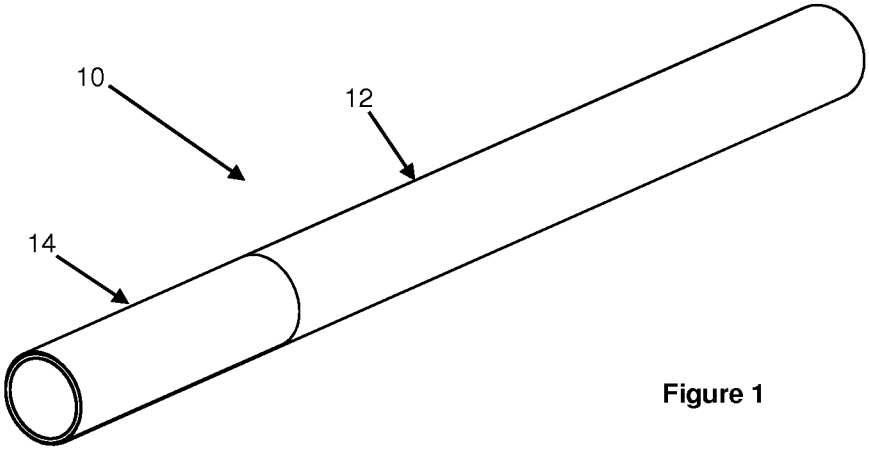
FIG. 1 shows a smoking article in accordance with the present invention.
Figure 2:
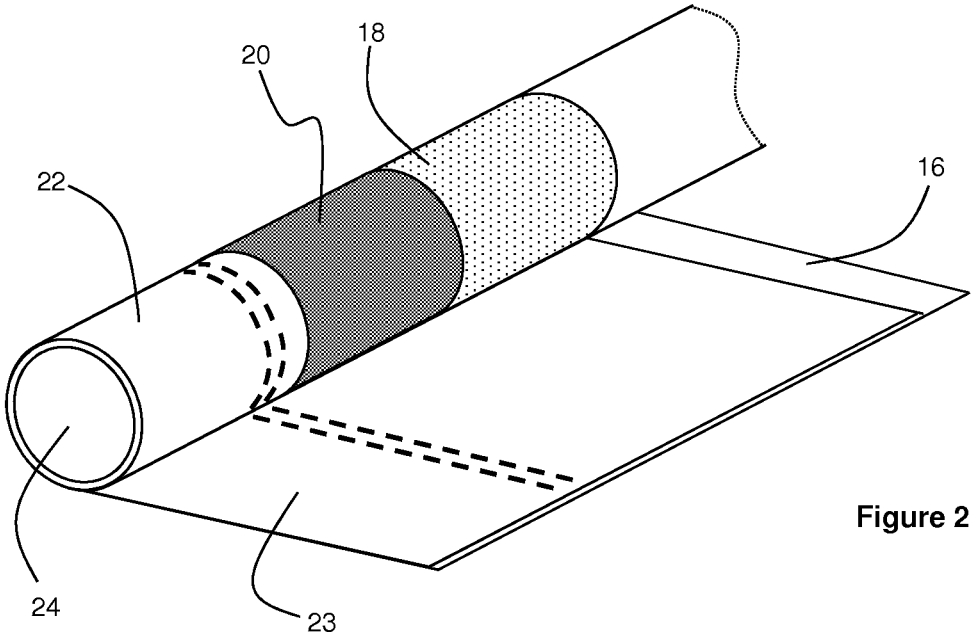
FIG. 2 shows the mouth end of the smoking article of FIG. 1 with the filter unwrapped.

FIGS. 1 and 2 illustrate a smoking article 10 in accordance with the present invention. The smoking article 10 comprises a wrapped rod 12 of tobacco cut filler which is attached at one end to an axially aligned filter 14. A band of tipping paper 16 circumscribes the filter 14 and a portion of the wrapped rod 12 of tobacco to join together the two portions of the smoking article 10.

As shown in FIG. 2, the filter 14 comprises a hollow tube segment 18, a first filter segment 20, which may or may not contain flavour, and a rod end filter segment 22. The hollow tube segment 18 and the filter segments 20 and 22 are circumscribed by a band of combining plug wrap 23 which connects the three segments to form the filter 14. One or more of the segments 18, 20, 22 may additionally be wrapped in an individual plug wrap.

The first filter segment 20 and the rod end filter segment 22 are formed of a suitable filtration material, such as cellulose acetate tow. Furthermore, the first filter segment may comprise a suitable flavourant, which may be provided in the form of one or more breakable capsules contained within the first filter segment 20. In this case, the one or more breakable capsules are ruptured by the consumer when desired by squeezing the first filter segment 20 between the consumer's fingers. The rod end filter segment 22 contains an adsorbent material, such as a carbon-based adsorbent material.

The hollow tube segment 18 defines a mouth end cavity 24 in the filter 14 and provides an unrestricted flow channel which extends between the downstream end of the first filter segment 20 and the mouth end of the filter 14. In more detail, the hollow tube segment 18 internally defines a channel having a substantially constant cross-sectional area for the smoke and air to flow through. Further, the hollow tube segment 18 does not contain any object adapted to cause a local restriction of the flow of the smoke and air. Thus, the cross-sectional area available for the smoke and air to flow through is substantially constant along the whole length of the hollow tube segment 18 and flow of smoke and air through the hollow tube segment 18 is unobstructed.

In the embodiment of FIGS. 1 and 2, the length of the hollow tube segment 18 is about 35 percent of the overall filter length. Further, the hollow tube segment 18 may have a wall thickness from about 100 micrometres to about 130 micrometres.

The hollow tube segment 18 may be formed of a plurality of spirally wound paper layers which can further improve the resistance to deformation of the mouth end cavity 24, for example during smoking or during rupture of the one or more breakable capsules when present in the first filter segment 20. The ovality of the hollow tube segment after a 50 percent deformation of the filter 14 may be less than 25 percent.

The smoking article 10 further comprises a ventilation zone 26 at a location along the hollow tube segment 18. In more detail, the ventilation zone 26 comprises two rows of perforations extending through the wall of the hollow tube segment 18. Two rows of perforations also extend through the band of combining plug wrap 23 and through the band of tipping paper 16. The rows of perforations extending through the band of combining plug wrap 23 and through the band of tipping paper 16 are substantially aligned with those extending through the wall of the hollow tube segment 18.

Figure 3:
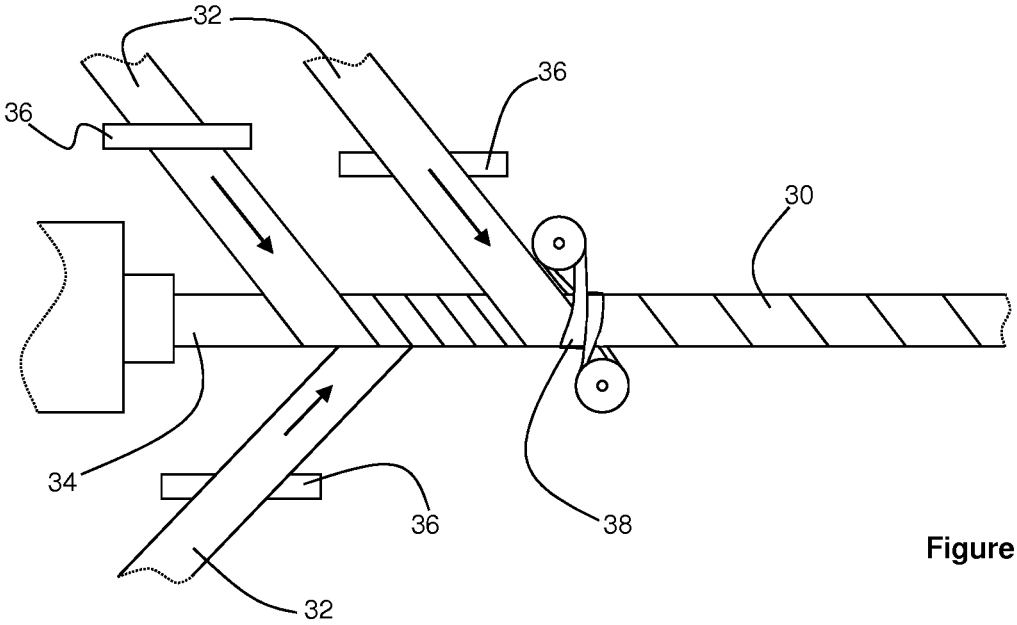
FIG. 3 shows an exemplary method of forming a tubular member for forming hollow tube segments in accordance with the present invention.

FIG. 3 shows an exemplary method of forming a hollow tube member 30 which can be cut to form a plurality of hollow tube segments for use in forming smoking articles in accordance with the present invention. A plurality of continuous paper plies 32 are spirally wound around a cylindrical mandrel 34 in a staggered, overlapping arrangement. A suitable adhesive may be applied to one or more of the plies 32 using an adhesive bath 36 prior to winding each ply around the mandrel 34. The plies 32 are driven by a rubber belt 38 so that the formed tubular member 30 rotates around the mandrel 34 until it is cut into desired lengths further downstream.

The invention claimed is:

1. A smoking article comprising:

a tobacco rod; and a filter connected to the tobacco rod, the filter comprising:

a first filter segment; and a hollow tube segment downstream of the first filter segment, the hollow tube segment defining a cavity at the downstream end of the filter providing an unrestricted flow channel that extends from the downstream end of the first filter segment to the downstream end of the filter, the cavity being open to an outer environment at the downstream end of the filter, wherein the hollow tube segment does not contain an object which may cause a local restriction of flow of smoke and air, wherein the length of the hollow tube segment is at least about 25 percent, and less than about 50 percent, of the overall filter length and wherein the smoking article comprises a ventilation zone in communication with the cavity at a location along the hollow tube segment, wherein the ventilation zone is located from about 10 mm to about 15 mm upstream from the downstream end of the filter, and wherein the length of the hollow tube segment is at least about 10 mm and is less than about 25 mm.

2. The smoking article according to claim 1, wherein the ventilation zone is located at least about 1 mm downstream from the downstream end of the first filter segment.

3. The smoking article according to claim 1, wherein the ventilation zone comprises at least one circumferential row of perforations provided through the hollow tube segment.

4. The smoking article according to claim 3, wherein the at least one circumferential row of perforations comprises from 8 to 30 perforations.

5. The smoking article according to claim 1, wherein the thickness of the hollow tube segment is from about 90 micrometres to about 140 micrometres.

6. The smoking article according to claim 1, wherein the thickness of the hollow tube segment is from about 100 micrometres to about 130 micrometres.

7. The smoking article according to claim 1, wherein the hollow tube segment is formed from a plurality of overlapping paper layers.

8. The smoking article according to claim 7, wherein the hollow tube segment is formed from a plurality of spirally wound paper layers.

9. The smoking article according to claim 7, wherein adjacent paper layers of the hollow tube segment are adhered together by an intermediate layer of an adhesive.

10. The smoking article according to claim 1, wherein the difference between the ovality of the hollow tube segment after 50 percent deformation of the filter and the ovality of the hollow tube segment prior to deformation of the filter is less than 25 percent.

11. The smoking article according to claim 1, wherein the ovality of the hollow tube segment after a 50 percent deformation of the filter is less than 25 percent.

* * * * *